US005184822A

United States Patent [19]

Bognar et al.

[11] Patent Number: 5,184,822

[45] Date of Patent: Feb. 9, 1993

[54] THREE-DIMENSIONAL PUZZLE

[76] Inventors: Jozsef Bognar, Feny u. 2.III.4., H-1024; Erno Rubik, Viragarok u. 11., H-1026 both of Budapest, Hungary

[21] Appl. No.: 613,863

[22] PCT Filed: Mar. 9, 1990

[86] PCT No.: PCT/HU90/00017

§ 371 Date: Dec. 28, 1990

§ 102(e) Date: Dec. 28, 1990

[87] PCT Pub. No.: WO90/10481

PCT Pub. Date: Sep. 20, 1990

[30] Foreign Application Priority Data

Mar. 10, 1989 [HU] Hungary ..... 1190/89

[51] Int. Cl.[5] ..... A63F 9/08

[52] U.S. Cl. ..... 273/153 R; 273/153 S; 273/456

[58] Field of Search ..... 273/153 R, 153 S, 155, 273/145 C, 146, 456, DIG. 14; 40/449

[56] References Cited

U.S. PATENT DOCUMENTS

| | | | |
|---|---|---|---|
| 416,344 | 12/1889 | Rice | 273/153 S |
| 537,168 | 4/1895 | Ormsby | 273/153 R |
| 3,883,988 | 5/1975 | Fields | 273/456 |
| 4,036,503 | 7/1977 | Golick | 273/153 S |

*Primary Examiner*—V. Millin
*Assistant Examiner*—William M. Pierce
*Attorney, Agent, or Firm*—Kenyon & Kenyon

[57] ABSTRACT

The invention provides a three-dimensional puzzle which consists of a box-like casing and a number of flat plate-like game pieces that are freely movable relative to each other within a closed system defined by the casing. The game pieces are, distinguishable from each other by markings such as symbols or color.

The casing is a substantially closed, shape-rententive hollow body of the shape of a geometric solid bound by lateral faces. At least four such lateral faces are identical to each other in size and shape. The interior of the casing serves as a game space for the enclosed game pieces. The game pieces are of a shape that is substantially identical to that of the at least four lateral faces of the casing and are laid out in size so that they are permitted free movement within the game space. A retaining means for releasably holding any one of the game pieces to any one of the at least four lateral faces of the casing is provided for at least one of each of the at least four lateral faces of the casing and/or the game pieces. By performing a sequence of rearranging steps, the game pieces can be moved into many possible positions within the game space. The goal of the puzzle lies in rearranging the game pieces so that they show at least one pre-determined characteristic pattern.

5 Claims, 2 Drawing Sheets

2
3, 31
4
1
3, 32
A
B
C
D 1
2
3, 31
4
A
D 1
2
3, 31
4
A
B
C
D 2
3, 31
4

THREE-DIMENSIONAL PUZZLE

BACKGROUND OF THE INVENTION

1. Field of the Invention

The invention relates to a three-dimensional puzzle comprising a box-like casing and a number of game pieces that are freely movable relative to each other within a closed system defined by the casing. The game pieces are, at least partially, marked and thus, are distinguishable from each other.

2. Description of the Related Art Three-dimensional logical toys comprising movable game elements or pieces that are marked, are provided with symbols, or are differently coloured, and as a result, are at least partially distinguishable from each other, have been known. In the known logical toys or puzzles, the game elements or pieces are movable, one by one or even groupwise, along courses of motion that are defined by a closed system of guide tracks. When playing with such logical toys or puzzles, an initial pre-determined characteristic pattern of the game pieces is first mixed up by moving the game pieces into various different positions along paths allowed by the system of guide tracks. After the initial characteristic pattern is mixed up, the player tries to bring the game pieces back into their initial characteristic pattern or into positions in which the game pieces show other, different pre-determined characteristic patterns through a sequence of steps. The efforts of the player are considered successful if the pre-determined characteristic pattern(s) of the game pieces are realized, or arrived at, by performing the shortest possible sequence of operational steps. In other words, satisfaction and success are achieved by finding, out of a large number of possible combinations, the simplest and thus, less time-consuming consuming sequence of steps or solution leading to certain pre-determined characteristic patterns of the puzzle.

The three-dimensional puzzle according to the present invention belongs to the wide range of spatial logical toys of the kind referred to above.

SUMMARY OF THE INVENTION

It is, accordingly, an object of the present invention to develop a puzzle by which the relationships between three-dimensional space and two-dimensional planar structures, the interrelation of inner and outer space characteristics, their specific features and regularities can be explored.

Another object of the present invention is to provide an article of manufacture comprising a puzzle consisting of the smallest number of game pieces that are of the simplest design.

It is a further object of the present invention to provide a puzzle which offers a considerably wide range of choices between possible step variations so that the player can entertain himself while the puzzle maintains his attention and improves his mechanical aptitude, simultaneously.

To achieve the foregoing objectives and in accordance with the purposes of the invention as embodied and broadly described herein, there is provided a three-dimensional puzzle comprising a container-like casing, the casing having an interior and being a substantially closed, shape-retentive hollow body having the shape of a geometric solid bound by lateral faces, at least four said lateral faces being identical to each other in size and shape; a number of flat plate-like game pieces that are freely movable relative to each other within a closed system defined by the casing, the game pieces being distinguishable from each other, the interior of the casing serving as a game space for the number of game pieces, and the game pieces being of a shape that is substantially identical to that of the at least four lateral faces of the casing, and laid out in size so that the game pieces are permitted free movement within the game space defined by the casing; and a retaining means for releasably holding any one of the game pieces to anyone of the at least four lateral faces of the casing, the retaining means provided for at least one of each of the at least four lateral faces of the casing and the game pieces.

BRIEF DESCRIPTION OF THE DRAWINGS

The manner by which the above and other subjects of the invention are obtained will be apparent from the following detailed description when considered with the accompanying drawings, wherein.

DETAILED DESCRIPTION OF THE PREFERRED EMBODIMENT

Figure 1:
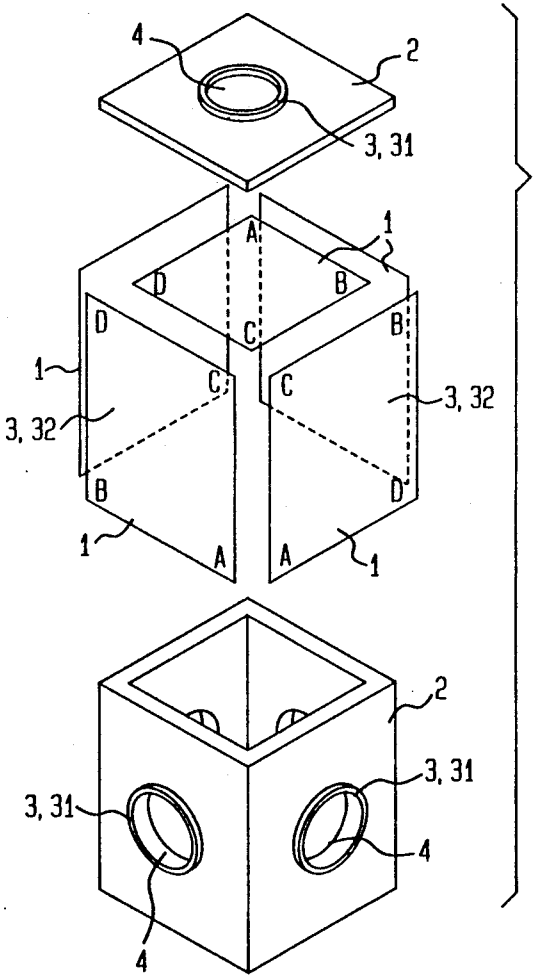
FIG. 1 is an exploded view of an embodiment of a three-dimensional puzzle according to the invention showing, in perspective, five flat plate-like game pieces in elevation and their box-like casing.
Figure 3:
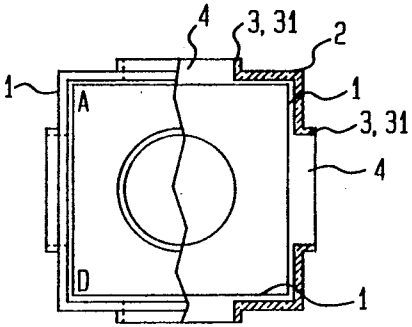
FIG. 3 shows in similar view, the puzzle casing according to the invention as shown in FIG. 2, together with encased game pieces.

The three dimensional puzzle of the present invention comprises a number of plate-like game pieces arranged movably within a game space of the shape of a geometric solid. The game pieces are of a substantially regular polygonal shape and they are, at least partially, marked by being colored or carrying identical and/or different symbols. They are enclosed in a framework, preferably a hollow box-like casing, whereby the puzzle forms a closed system. The flat plate-like game pieces are releasably held to lateral faces of the casing. The gripping force through which one game piece is held to any one of the lateral faces of the casing. The gripping force through which one game piece is held to any one of the lateral faces of the casing can be provided, for example, by magnetic pull or alternatively, by adhering friction induced via attractive forces generated locally by resilient deformation. Such releasable gripping force between a game piece and a lateral face of the casing is provided by retaining means. Since the game pieces are movably encased in the casing of the puzzle, they can be rearranged, i.e., moved into different positions with respect to each other and the casing within the game space bound by the casing. The possible movements of the game pieces are determined by general rules of space geometry and by the specific geometric dimensions of any particular design of the casing.

Movement of the game pieces for the purpose of their being brought into different positions within the game space can be performed either by directional shaking the box-like puzzle casing, by handling the game pieces directly with finger-tips through access openings or, by using any additional tool, for example, a pencil or the like for this purpose. Alternative, more sophisticated embodiments of the puzzle may also comprise actuating means arranged on the lateral faces of the casing for the purpose of indirect handling.

From the viewpoint of practical realization, embodiments of the puzzle having flat plate-like game pieces of substantially quadratic shape enclosed in a substantially cubiform casing having proved to be the simplest and most suitable for easy manufacture at low cost. Observation of the movements of the game pieces is made easy by arranging the game pieces in a substantially transparent casing.

The number of possible game step variations can be substantially increases if casings having lateral faces are provided with different symbols used and/or if, in a puzzle with a cubiform casing, six, instead of five, game pieces are movably arranged.

In accordance with the objects of the invention, the present invention provides as a novel and useful article of manufacture, a three-dimensional puzzle. The casing of the puzzle is a substantially closed, shape-retentive hollow body of the shape of a regular geometric solid bound by planar lateral faces. At least four such lateral faces are identical with each other in terms of shape and size. The interior of the casing serves as a game space for a number of encased flat plate-like game pieces of the shape that is substantially identical with that of the at least four lateral faces of the casing. The game pieces are laid out in size so that they are allowed to freely move within the game space defined by the casing. Each of the at least four lateral faces of the casing is provided with a retaining means for releasably holding any one of the game pieces to any one of the at least four lateral faces of the casing. In addition or alternatively, the game pieces are provided with retaining means for releasably holding any one of the game pieces to any one of the at least four lateral faces of the casing. In a preferred embodiment of the puzzle, each retaining means comprises at least one piece of preferably ferromagnetic substance. More particularly, in such a preferred embodiment, the flat plate-like game pieces may be, at least partially, of ferromagnetic material or they may comprise, fastened to them, at least one area of such ferromagnetic material. The retaining means of each of the at least four lateral faces of the casing may consist of at least one piece of permanent magnet capable of interacting with the (area of) ferromagnetic material of the game pieces.

In certain embodiments of the invention, the retaining means may simultaneously serve as a symbol, i.e., as means of making the game pieces, for example, by coloring or otherwise, so that they will become distinguishable from each other. When designed so, the function of retaining is—at least to a certain extent—substantially hidden or even disguised, so that such embodiments of the invention are made even more "puzzling".

In very simple and inexpensive embodiments of the puzzle, the retaining means may simply comprise at least one surface area of increased mechanical friction or adherence.

In a further preferred embodiment of the invention, for handling the puzzle, each of the at least four lateral faces can be provided with an actuating means for releasing the gripping force by which a game piece is temporarily and releasably held to a lateral face of the casing. In a cheaper embodiment, each of the at least four lateral faces of the casing may be provided as actuating means with an access opening for direct manual handling of the puzzle. Alternatively, there may be an additional embodiment in which on each of the at least four lateral faces of the casing, a sensor or push button serving as actuating means is provided for indirect holding of the game pieces of the puzzle. An advantage of this additional embodiment lies in the casing being closed, i.e., sealed hermetically, so that dust and dirt, etc. from the outside is excluded from access to the game space. All kinds of such actuating means for indirect handling perform, independently from their actual design, the act of pushing away the game piece from the lateral face to which it is held by a certain predetermined initial distance, whereby the gripping force maintained by magnetic pull or friction, for example, is ceased, and free movement of the game piece concerned is allowed.

Still further embodiments of the three-dimensional puzzle according to the invention without actuating means, i.e., without access openings or means such as a sensor or push buttons for indirect handling of the game pieces, are also possible. In such an embodiment, the temporary gripping force between a game piece and any lateral face of the casing to which the game piece is held may be overcome by exercising directional dynamic impacts to the game piece, for example, by shaking the puzzle with a certain skill that can easily be learned by experience. By such dynamic impacts of proper force and direction, the game piece can be forced to separate from the respective lateral face of the casing simply under its own weight and inertia.

In order to improve handling characteristics, a preferred embodiment of the invention may have a hollow casing of the shape of a substantially regular solid with cut-off or preferably rounded apical areas and/or edges. Such an embodiment, besides being a more suitable shape for manual handling, is less dangerous to children. Further, the cut-off or rounded apical areas, together with correspondingly cut-off or rounded corners of the flat plate-like game pieces, improve the freedom of movement of the latter in the game space.

As already mentioned above, in a preferred embodiment of the invention, the first plate-like game pieces are substantially cubiform hollow casing. At least some of the game pieces and/or at least some of the lateral faces of the casing should be substantially transparent. In a still further embodiment of the puzzle, for providing a wider range of possible solutions and/or step variations, at least some of the lateral faces of the casing may also be marked and/or provided with symbols and/or shaped openings or transparent areas.

In a preferred embodiment of the three-dimensional puzzle according to the invention, a box-like casing 2 as shown in FIG. 1 encloses flat plate-like game pieces 1. The casing 2 is a substantially closed, shape-retentive, hollow cubiform body bound by quadratic lateral faces that are identical with each other in both shape and size. The interior of the casing 2 serves as a game space for the movably encased flat plate-like game pieces 1. Altogether, there are five flat plate-like quadratic game pieces 1 which are of ferromagnetic, preferably iron, sheet material. Thus, each of the ferromagnetic game pieces 1 simultaneously forms a component part 32 of a retaining means 3, by which one such game piece 1 is releasably held to any one of the lateral faces of the casing 2. Corresponding component parts of the retaining means 3 are circular ring-shaped magnets 31. One such piece of ring shaped magnet 31 is fastened to substantially the middle area of each lateral face of the casing 2. The ring shaped magnetic 31 are arranged very much like circular window frames for access openings 4 serving as actuating means that are in central areas of the lateral faces surrounded by the circular ring-shaped magnets 31. The access openings 4 provide access to a game piece 1 held temporarily and releasably to a lateral face of the casing 2 for the purpose of releasing the gripping force provided by the magnetic pull between the ferromagnetic material of the plate-like game piece 1 and the ring shaped magnet 31 of the lateral face. Such release of the gripping force is best effected by a finger-tip push by the player against the middle area of the game piece 1 through the free access opening 4 in the lateral face, whereby the magnetic gripping force is overcome, and the particular game piece pushed is allowed free movement within the casing 2. The casing 2 has transparent lateral faces so that symbols A,B,C and D marked on the corners of the game pieces 1, can be observed and followed easily.

The embodiment of the three-dimensional puzzle described above can be handled as follows:

Assume that the puzzle has only one solution, at which the marked game pieces 1 together with the casing 2, show a specific, pre-determined characteristic pattern. Within the casing 2, the game pieces are able to perform two basic kinds of movement. They can shift in a parallel manner or they can tilt so as to rotate about each of their edges.

Consequently, by performing sequences of such shifts and tilts, the game pieces 1 can be moved relative to the casing 2 into every possible position within the game space defined by the lateral faces of the casing 2.

Figure 4:
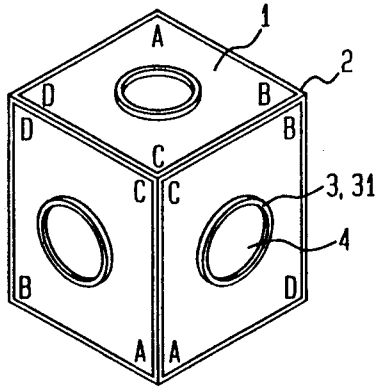
FIG. 4 is a perspective view of the embodiment of the puzzle according to the invention shown in FIG. 1.
Figure 2:
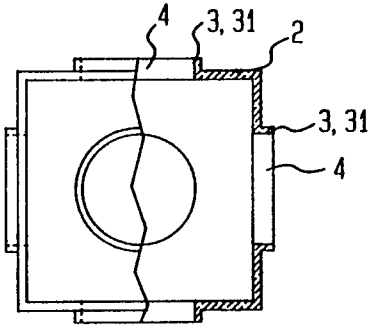
FIG. 2 shows an at least partially transparent puzzle casing according to the invention without game pieces contained, illustrated as a half view-half sectional view.

For the purpose of simplicity and easy understanding, the embodiment of the puzzle shown in the attached drawings comprises only five game pieces 1. Assume that these five game pieces 1 form a hollow box having five lateral faces, and that this hollow box is, showing a certain specific initial pre-determined characteristic pattern, arranged in the inside of the transparent casing 2. The inner faces of the hollow box formed by the five game pieces 1 can be seen when viewed through the bottom face of the casing 2 as shown in FIG. 1. As already mentioned, the surfaces of the plate-like game pieces 1 may be marked, i.e., provided with symbols, sections or parts of graphic pictures which, when the game pieces 1 are arranged properly, show a specific, pre-determined characteristic pattern. One such specific pattern could be seen, for example, in one particular arrangement on the resulting outer surfaces of the five game pieces, and in another particular arrangement on the resulting inner surfaces of game pieces 1. With the embodiment of the puzzle as shown in the attached drawings, instead of sections of a picture pattern, letters A,B,C and D are printed in respective corners of the game pieces 1. The puzzle is deemed to be solved if the game pieces 1 are in positions with their corners marked with the same letter being in one particular apex of the cubiform casing 2. FIGS. 1 and 4 of the attached drawings show such arrangements of the game pieces 1. In the course of playing, first the arrangement of the game pieces 1 that constitutes the solution of the puzzle has to be altered by rearranging, through any sequence of steps, the game pieces within the casing 2. Following this, the goal of the game lies in arriving at the initial regular specific pattern of the game pieces 1, possibly and preferably within the shortest period of time, i.e. by performing, out of a large number of variations, the shortest sequence of steps through which all game pieces 1 are moved back into their initial position.

Figure 9:
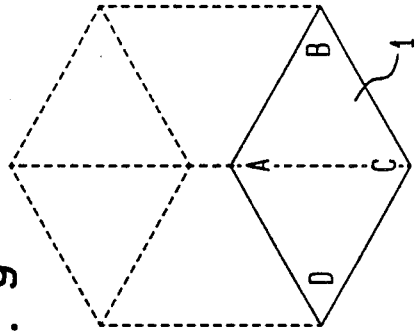
FIG. 9 shows in a simplified diagrammatic sketch, the game piece shown in FIGS. 5 and 6 after having arrived in its new position within the puzzle casing of the three-dimensional puzzle according to the invention.
Figure 5:
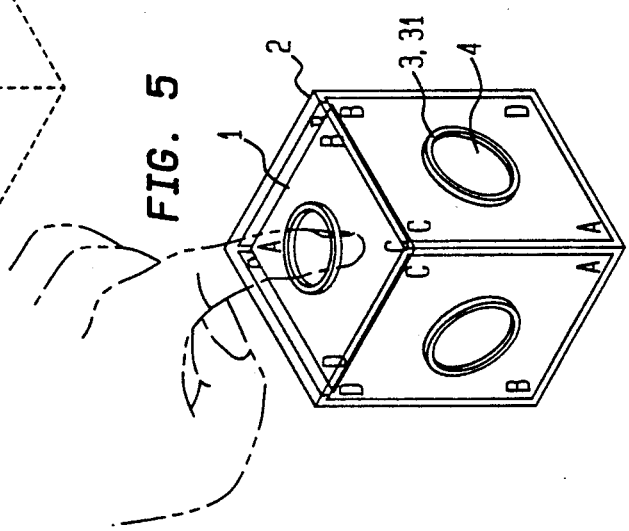
FIG. 5 shows the puzzle according to the invention in a state of playing, where a game piece that used to be held to the uppermost lateral face of the casing has just been caused to fall downward by a finger-tip push against the middle area of such game piece through an access opening of the uppermost lateral face.

With the particular embodiment of the puzzle as shown in the attached drawings one step of rearrangement is performed by causing any one of the game pieces 1 to move to the previously unoccupied sixth lateral face of the casing 2. In order to do this, the casing 2 of the puzzle has to be turned in a position where the unoccupied lateral face goes to the lowermost, bottom position. After having done so, the game piece 1 occupying now the uppermost, top lateral face position can be caused to fall down in a parallel manner and thus, arrive at the bottom position by releasing the gripping force by which it is held to the top lateral face of the casing. This can be performed as clearly shown in FIG. 5 of the attached drawings, by exerting a slight push with the player's finger-tip against the game piece 1 in question through the free access opening 4 of the top lateral face of the casing 2. By exerting such a slight push, an initial distance is opened between the ring shaped magnet 31 and the game piece 1 concerned. As a result, the magnetic pull of the retaining means 3 will gradually be overcome by the weight of the game piece 1 and the latter will fall downward until it arrives in its new, desired position adjacent to the previously unoccupied lateral bottom face of the casing 2. Here, it is gripped by the bottom ring shaped magnet 31 and is securely held in its new position as shown in FIG. 9.

Figure 8:
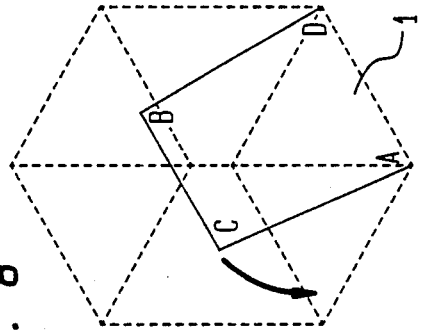
FIG. 8 is a simplified diagrammatic picture illustrating the momentary position of the game piece moving relative to the casing of the puzzle in substantially the same instant state of play as shown in FIG. 7.
Figure 6:
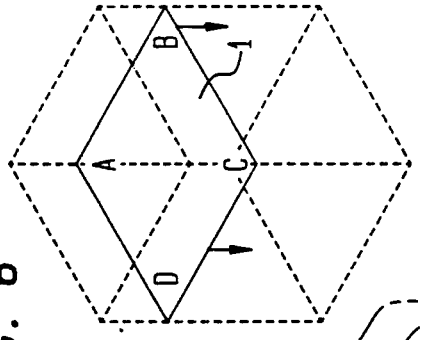
FIG. 6 is a simplified diagrammatic picture showing the momentary position of the game piece moving relative to the casing of the puzzle in the same instant state of play as shown in FIG. 5.
Figure 10:
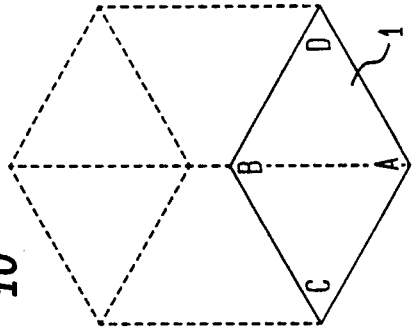
FIG. 10 illustrates the game piece shown in FIGS. 7 and 8 after its arrival in the new position within the casing of the three-dimensional puzzle according to the present invention.
Figure 7:
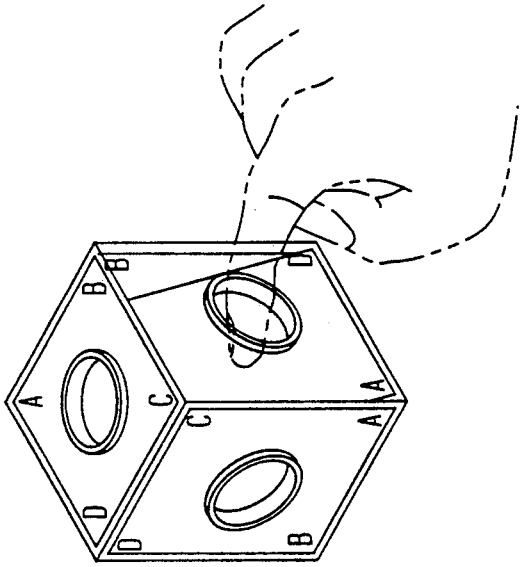
FIG. 7 shows an embodiment of the puzzle according to the invention in an instant state of playing, where a game piece that used to be held to the right hand lateral face of the casing has just been caused to tilt downward by a finger-tip of the player exercised against such game plate through an access opening of the right-hand lateral face of the casing.

Alternatively, any of the vertically standing game pieces 1 can be moved to the unoccupied bottom face of the casing 2. An example, for the sole purpose of illustration, is shown in FIG. 7 of the drawings. The only difference lies in that instead of being shifted in a parallel direction, the vertical game piece is tilted about its bottom edge in order to arrive at its new, desired position as clearly shown in FIG. 8. FIG. 10 illustrates the game piece tilted in its new position. After having performed one such step of rearrangement, the puzzle is turned again into a position where its now unoccupied lateral face is in the bottom face position.

By performing sequences of the above steps of rearrangement, variations of the positions of the game pieces 1 relative to each other and, if also marked properly, relative to the lateral faces of the casing 2, can be realized. Arriving at a pre-determined specific pattern of the game pieces 1 will prove to be a hard task despite the fact that handling the puzzle seems, at least at first instance, to be very easy.

While handling the puzzle with the aim of solving the problem of how to arrive at a solution, the player will automatically be confronted with questions regarding the relationship between a three-dimensional space and planer structures contained and moved therein.

Problems of interrelating the senses of rotation, the reversibility of coordinate systems, and the terms of "outside" and "inside" will gradually become more and more apparent to regular and enthusiastic users of the puzzle.

Additional advantages and modifications will readily occur to those skilled in the art. The invention in its broader aspects is not, therefore, limited to the specific details, representative methods and illustrative examples shown and described. Accordingly, departures may be made from such details without departing from the spirit or scope of Applicants' general inventive concept.

What is claimed is:

1. A three-dimensional puzzle comprising:

a container-like casing, said casing having an interior and being a substantially closed, shape-retentive hollow body having the shape of a geometric solid bound by lateral faces, at least 3 said lateral faces being identical to each other in size and shape;

a number of flat plate-like game pieces that are freely movably relative to each other within the interior defined by said casing, said game pieces being distinguishable from each other, the interior of said casing serving as a game space for said number of game pieces, and said game pieces being of a shape that is substantially identical to that of said at least four lateral faces of said casing and being of a size that is approximately that of said at least four lateral faces, though said game pieces are sized slightly smaller so that said game pieces are permitted free movement within said game space defined by said casing; and a retaining means for releasably holding with a gripping force any one of said game pieces to any one of said at least four lateral faces of said casing, said retaining means provided for at least one of each of said at least four lateral faces of said casing and said game pieces; and wherein, for handling the puzzle, each of said at least four lateral faces is further provided with an actuating means for releasing said gripping force by which any one of said game pieces is temporarily and releasably held to any one of said lateral faces of said casing, and said actuating means comprises an access opening in each of said at least four lateral faces of said casing which permits direct manual handling of the puzzle.

2. A three-dimensional puzzle comprising:

a container-like casing, said casing having an interior and being a substantially closed, shape-retentive hollow body having the shape of a geometric solid bound by lateral faces, at least four said lateral faces being identical to each other in size and shape;

a number of flat plate-like game pieces that are freely movably relative to each other within the interior defined by said casing, said game pieces being distinguishable from each other, the interior of said casing serving as a game space for said number of game pieces, and said game pieces being of a shape that is substantially identical to that of said at least four lateral faces of said casing and being of a size that is approximately that of said at least four lateral faces, though said game pieces are sized slightly smaller so that said game pieces are permitted free movement within said game space defined by said casing; and a retaining means for releasably holding with a gripping force any one of said game pieces to any one of said at least four lateral faces of said casing, said retaining means provided for at least one of each of said at least four lateral faces of said casing and said game pieces; and wherein at least some of said game pieces have transparent portions.

3. A three-dimensional puzzle comprising:

a container-like casing, said casing having an interior and being a substantially closed, shape-retentive hollow body having the shape of a geometric solid bound by lateral faces, at least four said lateral faces being identical to each other in size and shape;

a number of flat plate-like game pieces that are freely movably relative to each other within the interior defined by said casing, said game pieces being distinguishable from each other, the interior of said casing serving as a game space for said number of game pieces, and said game pieces being of a shape that is substantially identical to that of said at least four lateral faces of said casing and being of a size that is approximately that of said at least four lateral faces, though said game pieces are sized slightly smaller so that said game pieces are permitted free movement within said game space defined by said casing; and a retaining means for releasably holding with a gripping force any one of said game pieces to any one of said at least four lateral faces of said casing, said retaining means provided for at least one of each of said at least four lateral faces of said casing and said game pieces; and wherein at least some of said lateral faces of said casing are inscribed with symbols.

4. A three-dimensional puzzle comprising:

a container-like casing, said casing having an interior and being a substantially closed, shape-retentive hollow body having the shape of a geometric solid bound by lateral faces, at least four said lateral faces being identical to each other in size and shape;

a number of flat plate-like game pieces that are freely movable relative to each other within the interior defined by said casing, said game pieces being distinguishable from each other, the interior of said casing serving as a game space for said number of game pieces, and said game pieces being of a shape that is substantially identical to that of said at least four lateral faces of said casing and being of a size that is approximately that of said at least four lateral faces, though said game pieces are sized slightly smaller so that said game pieces are permitted free movement within said game space defined by said casing; and retaining means for releasably holding with a gripping force any one of said game pieces to any one of said at least four lateral faces of said casing, said retaining means provided for at least one of each of said at least four lateral faces of said casing and said game pieces; and wherein at least some of said lateral faces of said casing have shaped openings through said faces.

5. A three-dimensional puzzle comprising:

a container-like casing, said casing having an interior and being a substantially closed, shape-retentive hollow body having the shape of a geometric solid bound by lateral faces, at least four said lateral faces being identical to each other in size and shape;

a number of flat plate-like game pieces that are freely movable relative to each other within the interior defined by said casing, said game pieces being distinguishable from each other, the interior of said casing serving as a game space for said number of game pieces, and said game pieces being of a shape that is substantially identical to that of said at least four lateral faces of said casing and being of a size that is approximately that of said at least four lateral faces, though said game pieces are sized slightly smaller so that said game pieces are permitted free movement within said game space defined by said casing; and a retaining means for releasably holding with a gripping force any one of said game pieces to any one of said at least four lateral faces of said casing, said retaining means provided for at least one of each of said at least four lateral faces of said casing and said game pieces; and wherein at least some of said lateral faces of said casing having shaped transparent areas.

* * * * *